US006972149B2

(12) United States Patent
Kuipers et al.

(10) Patent No.: US 6,972,149 B2
(45) Date of Patent: Dec. 6, 2005

(54) ARTIFICIAL SHINGLE

(76) Inventors: Charles Kuipers, P.O. Box 524, Blue Ball, PA (US) 17506; Samuel Stoltzfus, P.O. Box 524, Blue Ball, PA (US) 17506

( * ) Notice: Subject to any disclaimer, the term of this patent is extended or adjusted under 35 U.S.C. 154(b) by 20 days.

(21) Appl. No.: 10/692,132

(22) Filed: Oct. 23, 2003

(65) Prior Publication Data

US 2005/0089672 A1 Apr. 28, 2005

(51) Int. Cl.[7] ..... B32B 3/00; E04D 1/00; E04D 1/24

(52) U.S. Cl. ..... 428/156; 428/182; 428/212; 52/313; 52/516; 52/535; 52/550; 52/558; 52/560

(58) Field of Search ..... 428/141, 156, 428/167, 182, 187, 212, 558, 560; 52/523, 52/524, 526, 528, 535, 536, 537, 540, 541, 52/547, 550, 557, 555, 558, 313, 516, 560

(56) References Cited

U.S. PATENT DOCUMENTS 1,534,165 A * 4/1925 Cumfer ..... 52/546
4,290,248 A * 9/1981 Kemerer et al. ..... 52/309.16
5,295,339 A * 3/1994 Manner ..... 52/518

* cited by examiner

*Primary Examiner*—Donald J. Loney
(74) *Attorney, Agent, or Firm*—Gerhard P. Shipley

(57) ABSTRACT

An artificial shingle adapted for mounting on substantially any roof surface (e.g., spaced slat- or solid sheathing-type construction) whereupon conventional shingles might alternatively be mounted, wherein the artificial shingle provides superior cost, wear, fire resistance, weight, or other characteristics while presenting a substantially realistic appearance and resemblance to a natural material (e.g., slate, cedar). The artificial shingle comprises a top surface and a bottom surface. A lower top exposure portion of the top surface and an upper bottom exposure portion of the bottom surface are both provided (e.g., stamped, molded, imprinted) with a relief or three-dimensional pattern substantially resembling the natural material of which conventional shingles are constructed. Other features include a midline groove with a cuttable end tab, and a portion of reduced thickness with strengthening corrugations.

11 Claims, 6 Drawing Sheets

ARTIFICIAL SHINGLE

BACKGROUND OF THE INVENTION

1. Field of the Invention

The present invention relates broadly to artificial shingles for roof structures. More particularly, the present invention concerns an artificial shingle having a relief or three-dimensional pattern resembling a natural material (e.g., cedar, slate) provided on both a top surface and a bottom surface so as to allow for roof structure construction that leaves the bottom surface exposed and visible. The shingle also includes a midline groove of reduced thickness extending the length of the elongated body to facilitate bending the artificial shingle to accommodate non-planar areas of the roof structure (e.g., ridgeline, hip, valley), wherein the midline groove is provided with a cuttable end tab that can be cut as needed to facilitate folding the artificial shingle but that otherwise advantageously conceals the presence of the midline groove when the artificial shingle is mounted. The shingle also includes an additional portion of reduced thickness to reduce cooling and set-up time during manufacture and decrease overall weight and material cost of the shingle, wherein the portion is provided with corrugations that act to increase stiffness and strength and prevent sag which might otherwise arise due to the reduced thickness.

2. Description of the Prior Art

It is often desirable to cover a roof structure with shingles constructed from such aesthetically-pleasing natural materials as cedar or slate. Unfortunately, these natural shingles suffer from a number of disadvantages, including, for example, relatively high cost; high fire risk in the case of cedar shingles; and high total weight in the case of slate shingles. Furthermore, accommodating non-planar areas of the roof structure such as, for example, ridgelines, hips, or valleys, can be difficult and time-consuming.

It is known in the prior art to employ artificial shingles in place of natural shingles in order to overcome some of these limitations. These prior art artificial shingles are typically constructed of a long-wearing, light-weight synthetic material that is colored and stamped with a wood grain or stone pattern to present a substantially realistic appearance and resemblance to a natural material (e.g., slate, cedar). The prior art artificial shingles provide substantial advantages over natural shingles, including, for example, lower cost; longer wear; better fire resistance; lower weight; reduced weathering, discoloration, susceptibility to mold, and maintenance; decreased dust generated during cutting prior to mounting; and decreased risk of splitting during installation.

Unfortunately, prior art artificial shingles also suffer from a number of disadvantages, including, for example, that typically only the top, exposed surface of the shingles are stamped so as to have a natural appearance. This means that the prior art artificial shingles cannot be used in roof structure applications where a substantial portion of the underside of the shingles is visible from a vantage point beneath the roof structure. Furthermore, the prior art artificial shingles are also not well suited for accommodating non-planar areas of the roof structure.

In light of these and other limitations and disadvantages with prior art artificial shingles, there exists a need for an improved artificial shingle.

SUMMARY OF THE INVENTION

The present invention overcomes the above-described and other disadvantages associated the prior art by providing an improved artificial shingle adapted for mounting on substantially any roof surface (e.g., spaced slat- or solid sheathing-type construction) whereupon conventional shingles might alternatively be mounted. The artificial shingle broadly comprises an elongated body having a top surface, a bottom surface, an upper end, and a lower end. The artificial shingle is constructed of an appropriate artificial or synthetic material that is both long-wearing and water resistant. The top surface includes an upper top overlap portion and a lower top exposure portion, with the lower top exposure portion being provided (e.g., stamped, molded, imprinted) with a relief or three-dimensional pattern substantially resembling the natural material of which conventional shingles are constructed.

The bottom surface includes an upper bottom exposure portion and a lower bottom overlap portion, with the upper bottom exposure portion being provided with the aforementioned relief or three-dimensional pattern. This advantageously allows for a wider choice of roof structure design than was possible with prior art artificial shingles, including, for example, use of the aforementioned spaced slats.

Additional advantageous features of the artificial shingle of the present invention include a midline groove of reduced thickness extending the length of the elongated body to facilitate bending the artificial shingle to accommodate non-planar areas of the roof structure (e.g., ridgeline, hip, valley), wherein the midline groove is provided with a cuttable end tab that can be cut as needed to facilitate folding the artificial shingle but that otherwise advantageously conceals the presence of the midline groove when the artificial shingle is mounted. Furthermore, an additional portion of reduced thickness may be incorporated into a thickest part of the shingle to reduce cooling and set-up time during manufacture and decrease overall weight and material cost of the shingle, wherein the portion is provided with corrugations that act to increase stiffness and strength and prevent sag which might otherwise arise due to the reduced thickness.

These and other important aspects of the present invention are more fully described in the section entitled DETAILED DESCRIPTION, below.

BRIEF DESCRIPTION OF THE DRAWINGS

A preferred embodiment of the present invention is described in detail below with reference to the attached drawing figures, wherein.

DETAILED DESCRIPTION OF A PREFERRED EMBODIMENT

Figure 1:
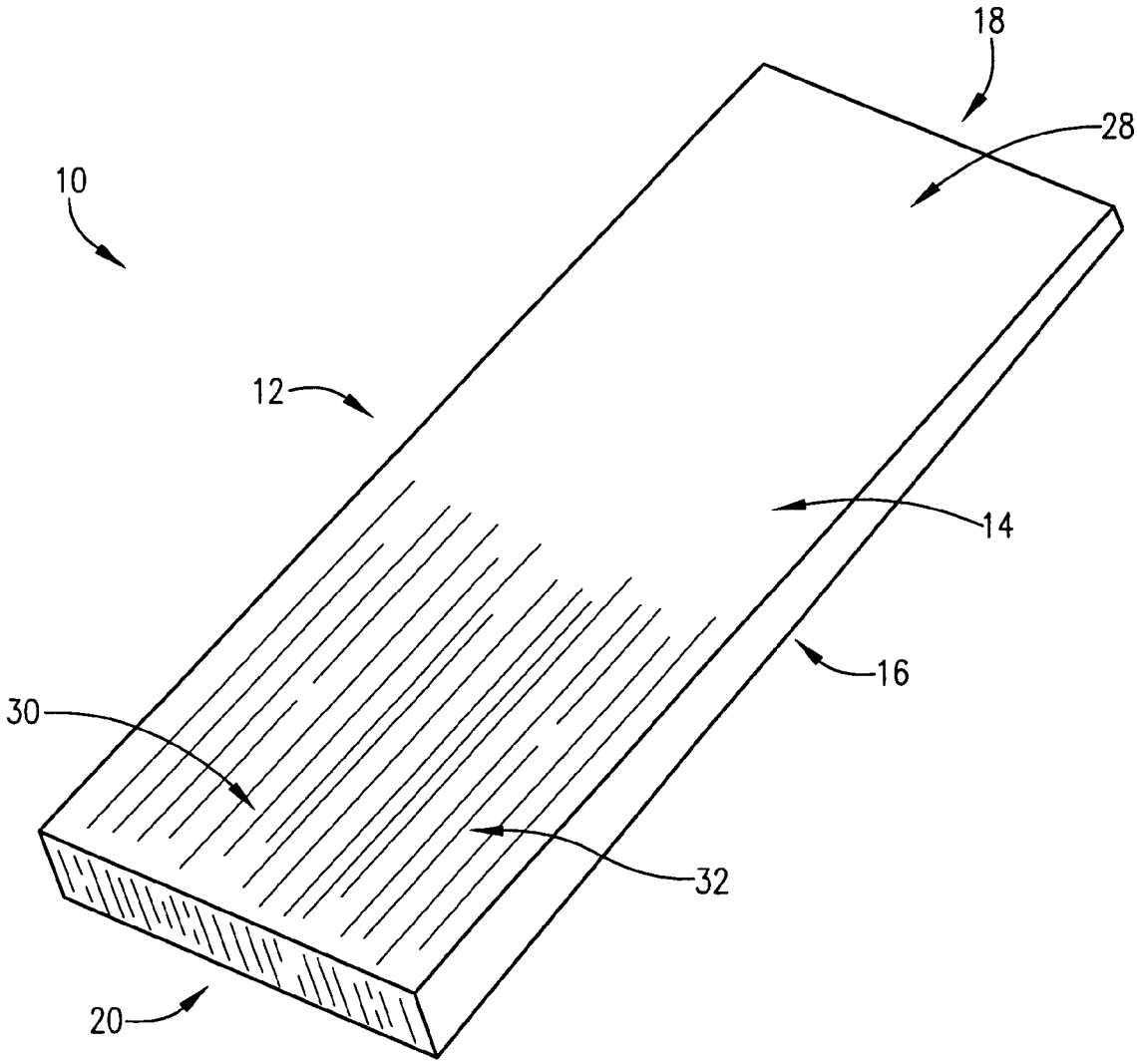
FIG. 1 is an isometric view of a top surface of a preferred embodiment of an artificial cedar shingle of the present invention.

With reference to the figures, an artificial shingle 10 is herein described, shown, and otherwise disclosed in accordance with a preferred embodiment of the present invention. Broadly, the artificial shingle 10 is adapted for mounting on substantially any roof surface (e.g., spaced slat- or solid sheathing-type construction) whereupon conventional shingles might alternatively be mounted, wherein the artificial shingle 10 provides the advantages of superior cost, wear, fire resistance, and weight; reduced weathering, discoloration, susceptibility to mold, and maintenance; decreased dust generated during cutting prior to installation; decreased risk of splitting during installation; and other advantageous characteristics while presenting a substantially realistic appearance and resemblance to a natural material (e.g., slate, cedar).

As illustrated, the preferred embodiment of the artificial shingle 10 broadly comprises an elongated body 12 having a top surface 14, a bottom surface 16, an upper end 18, and a lower end 20. The artificial shingle 10 is constructed of an appropriate artificial or synthetic material that is both long-wearing and water resistant. The elongated body 12 is preferably approximately between 12 inches and 24 inches in length, and approximately between 4 inches and 18 inches in width, or otherwise appropriately dimensioned so to present the aforementioned realistic appearance and resemblance to conventional shingles constructed of natural material.

Referring particularly to FIG. 1 wherein a cedar version of the artificial shingle 10 is shown, the top surface 14 includes an upper top overlap portion 28 and a lower top exposure portion 30. When the artificial shingle 10 is mounted upon the roof structure in a conventional arrangement of overlapping courses, the lower top exposure portion 30 will remain visible, while the upper top overlap portion 28 will be substantially concealed beneath a higher course. Thus, the lower top exposure portion 30 is provided (e.g., stamped, molded, imprinted) with a relief or three-dimensional pattern 32 substantially resembling the natural material of which conventional shingles are constructed. If, for example, the natural material is cedar or another wood, then the relief pattern 32 would present a corresponding wood grain pattern. The upper portion 28 may, as desired, be substantially flat, with no relief pattern. Preferably, the lower top exposure portion 30 extends over approximately between 50% and 75% of the top surface 14, with the exact percentage depending at least in part on the degree of desired exposure.

Figure 2:
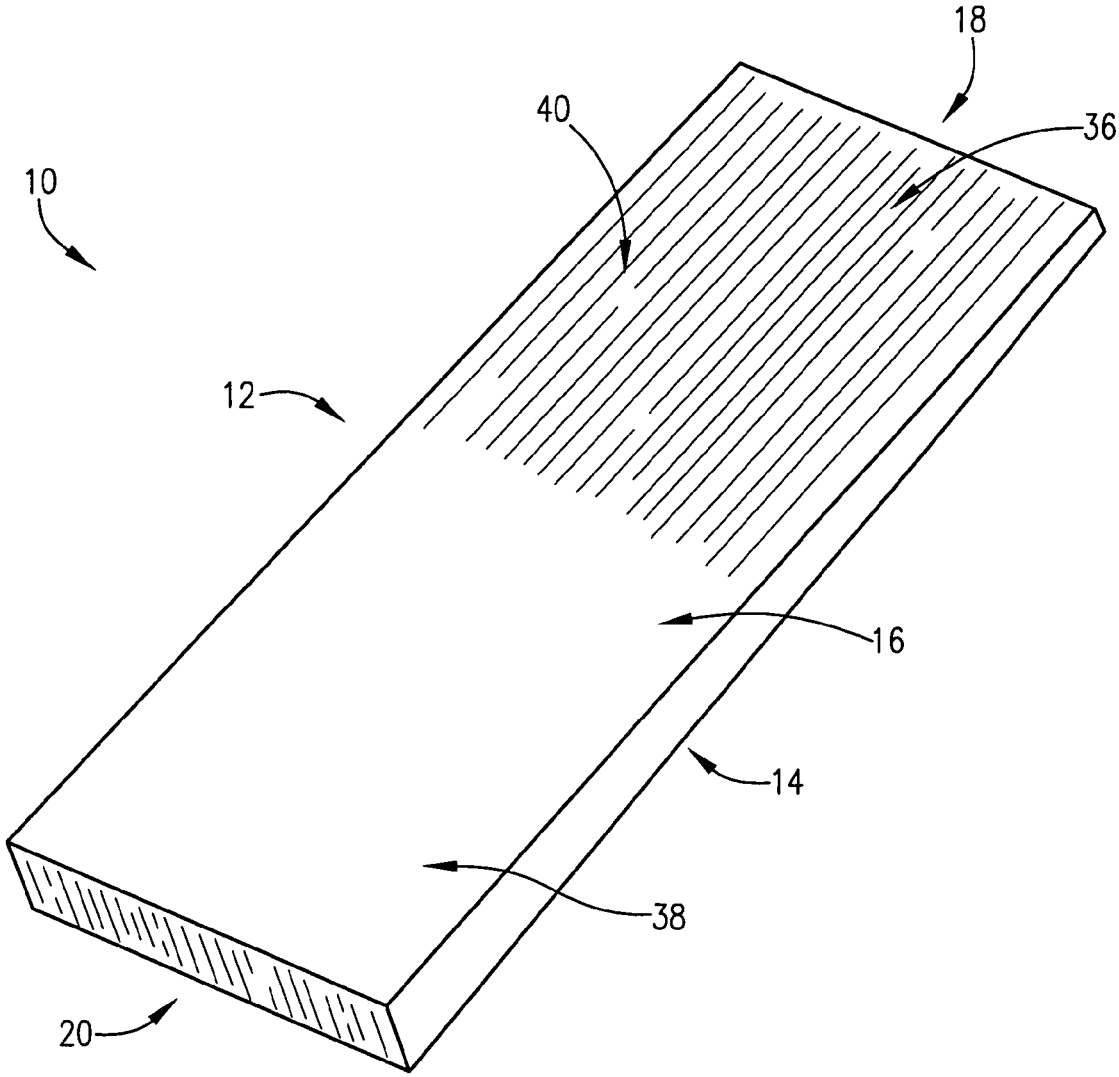
FIG. 2 is an isometric view of a bottom surface of the artificial cedar shingle of FIG. 1.

Referring particularly to FIG. 2, the bottom surface 16 includes an upper bottom exposure portion 36 and a lower bottom overlap portion 38. In certain applications, it is desirable to design the roof structure so as to allow for viewing the bottom surface 16 of the mounted artificial shingle 10. The roof structures of gazebos and similar shelters, for example, may make use of spaced slats through which the bottom surface 16 can be seen, rather than solid sheets of plywood. Prior art artificial shingles do not provide a realistic-appearing bottom surface, thereby necessitating that plywood or other solid sheathing or underlayment be used to conceal the bottom surface in order to preserve the overall illusion of natural shingle material. The upper bottom exposure portion 36 of the artificial shingle 10 of the present invention, however, is provided with a relief or three-dimensional pattern 40 that is identical or substantially similar to the pattern 32 of the lower top exposure portion 30 of the top surface 14. This advantageously allows for a wider choice of roof structure design, including, for example, use of the aforementioned spaced slats. The lower bottom overlap portion 38 may, as desired, be substantially flat, with no relief pattern. Preferably, the upper bottom exposure portion 36 extends over approximately between 50% and 75% of the bottom surface 16, with the exact percentage depending at least in part on the degree of desired exposure of the lower top exposure portion of the top surface 14 of the artificial shingle 10.

With regard to the general thickness of the artificial shingle 10, the lower end 20 is preferably thicker than the upper end 18 such that the elongated body 12 tapers so as to achieve a more realistic appearance and encourage desirable water flow characteristics over the artificial shingle 10. The lower end 20 is preferably approximately between 0.25 inches and 0.75 inches in thickness, depending in part on the natural material being mimicked. Where the artificial shingle 10 mimics cedar, for example, the thickness of the lower end 20 is preferably approximately 0.625 inches. It will be appreciated that the taper may result from a gradual decrease in thickness across the entire length of the elongated body 12; from a stepped decrease in thickness; or from a combination thereof, as desired.

Figure 3:
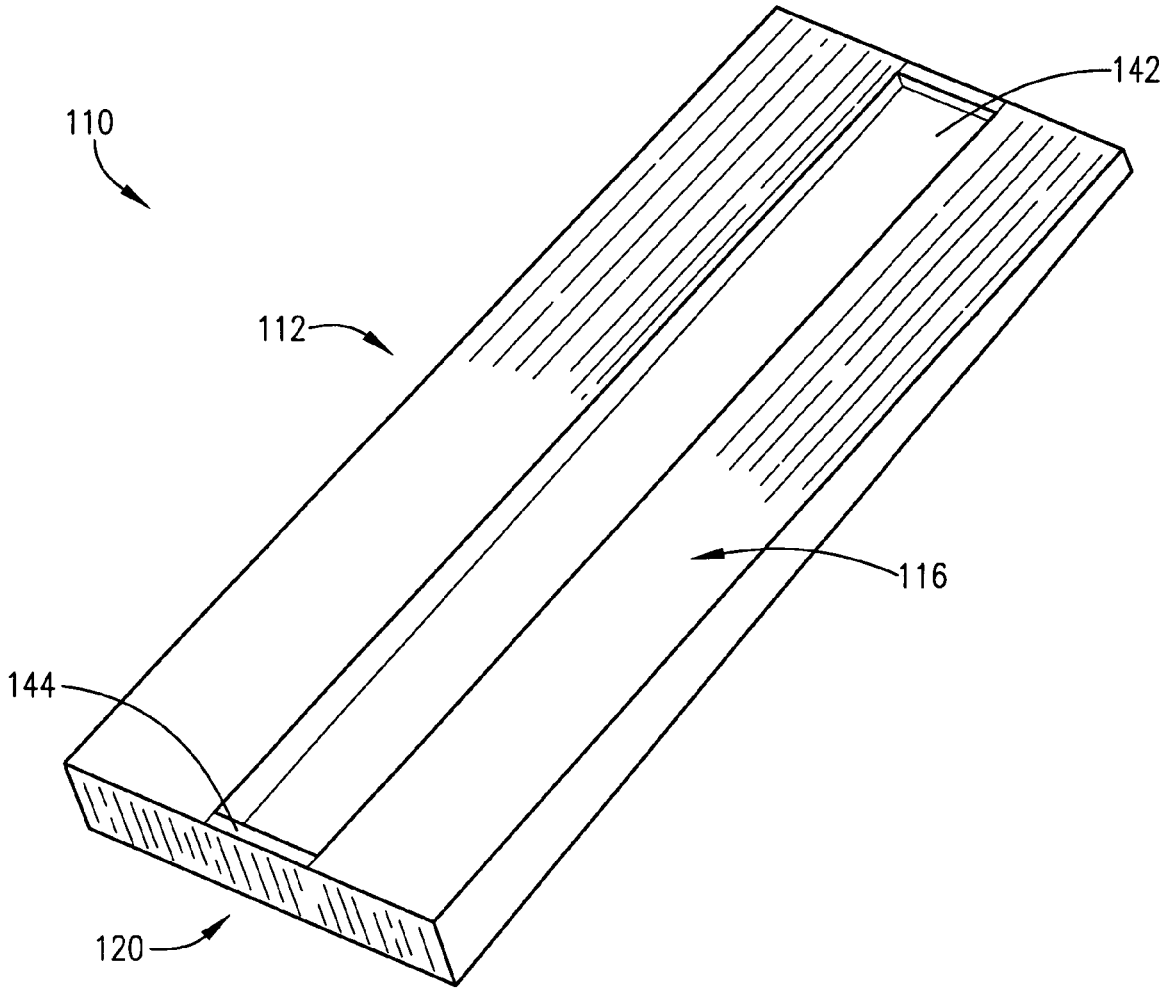
FIG. 3 is an isometric view of a first alternative implementation of the bottom surface of the artificial cedar shingle of FIG. 1, wherein a midline groove is provided to facilitate bending or folding the shingle.

Referring particularly to FIG. 3, a first alternative implementation of the bottom surface 116 of the artificial cedar shingle 110, is shown wherein a midline groove 142 and cuttable end tab 144 are provided to facilitate bending or folding the shingle 110 to accommodate non-planar areas of the roof structure (e.g., ridgeline, hip, valley). More specifically, the midline groove 142 is a region of reduced thickness extending the length of the elongated body 112. The midline groove 142 may be created during manufacture of the artificial shingle 110 using a retractable or otherwise removable slug whose presence in the shingle mold results in the midline groove 142. The cuttable end tab 144 is located at the bottom end 120 of the elongated body 112 and can be cut as needed to facilitate folding the artificial shingle 110, but otherwise substantially conceals the presence of the midline groove 142 when the artificial shingle 110 is mounted.

Figure 4:
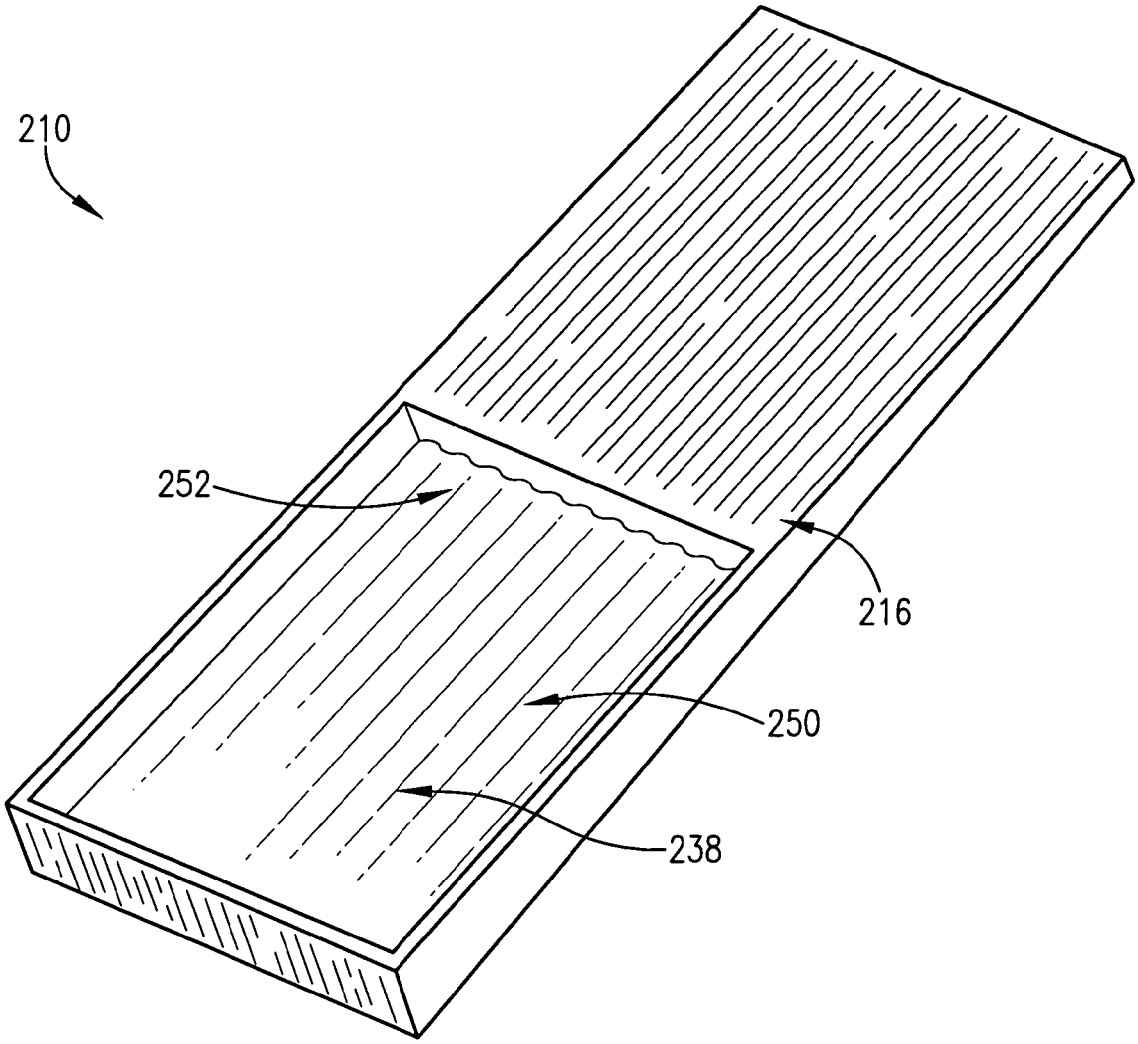
FIG. 4 is an isometric view of a second alternative implementation of the bottom surface of the artificial cedar shingle of FIG. 1, wherein a thicker bottom portion of the shingle has been reduced in thickness in order to facilitate manufacture and reduce weight and material costs.

Referring particularly to FIG. 4, a second alternative implementation of the bottom surface 216 of the artificial shingle 210 is shown wherein a portion 250 of the lower bottom overlap portion 238 has been reduced in thickness in order to facilitate manufacture and reduce weight and material costs. As mentioned, the artificial shingle will typically be provided with a substantial thickness in order to more closely present the aforementioned realistic appearance and resemblance to conventional shingles constructed of natural material. The increased thickness of the lower bottom overlap portion in particular can substantially increase cooling and set-up times during manufacture, and can add substantially to the overall weight and material cost of the shingle. The second alternative implementation of the bottom surface 216 addresses and overcomes these concerns by reducing the thickness of the aforementioned portion 250 of the lower bottom overlap portion 238 without adversely affecting the appearance of the mounted shingle 210. The portion 250 of reduced thickness may be created during manufacture of the artificial shingle 210 using a retractable or otherwise removable slug whose presence in the mold results in a cavity that provides the desired degree of reduced thickness but that cannot be seen once the shingle 210 is mounted.

The portion 250 of reduced thickness is preferably provided with corrugations 252 to increase stiffness and strength and prevent sag which might otherwise arise due to the reduced thickness. It should also be noted that the combination of the reduced thickness and the corrugations 252 provides a shading effect that adds to the realistic appearance of the shingle 210.

Figure 5:
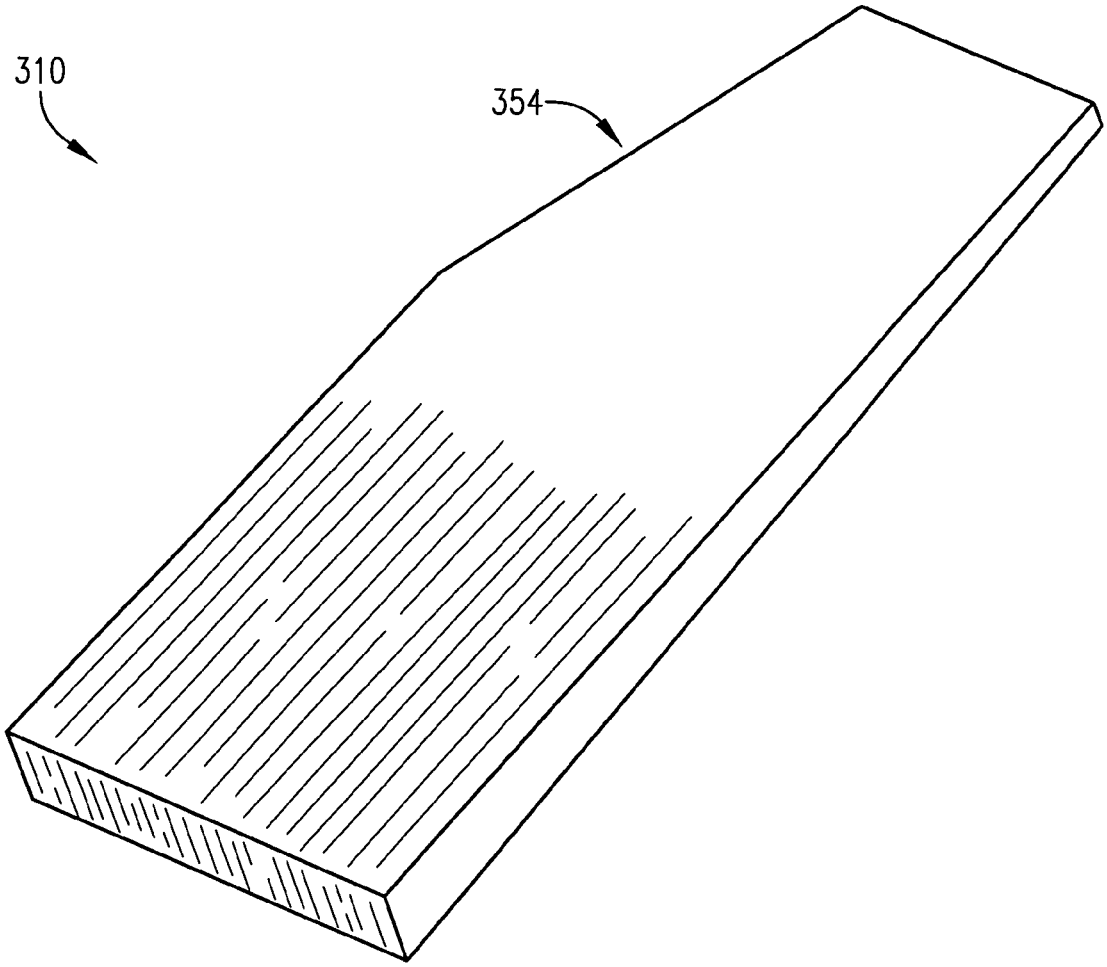
FIG. 5 is an isometric view of the artificial cedar shingle, wherein the shingle has been manufactured so as to present an angular corner in order to accommodate angular roof structures.

Referring particularly to FIG. 5 the artificial cedar shingle 310 is shown wherein an angled corner 354 is created during manufacturing to accommodate angular roof structures, particularly for shingles to be used in so-called "starter strips". This advantageously eliminates any need to cut the shingle 310 at the job site during mounting. The angled corner 354 may be created during manufacture of the artificial shingle 310 using a retractable or otherwise removable slug whose presence in the mold results in the desired angle at the corner. Typically, the angle will be approximately between 20° and 25°.

Figure 6:
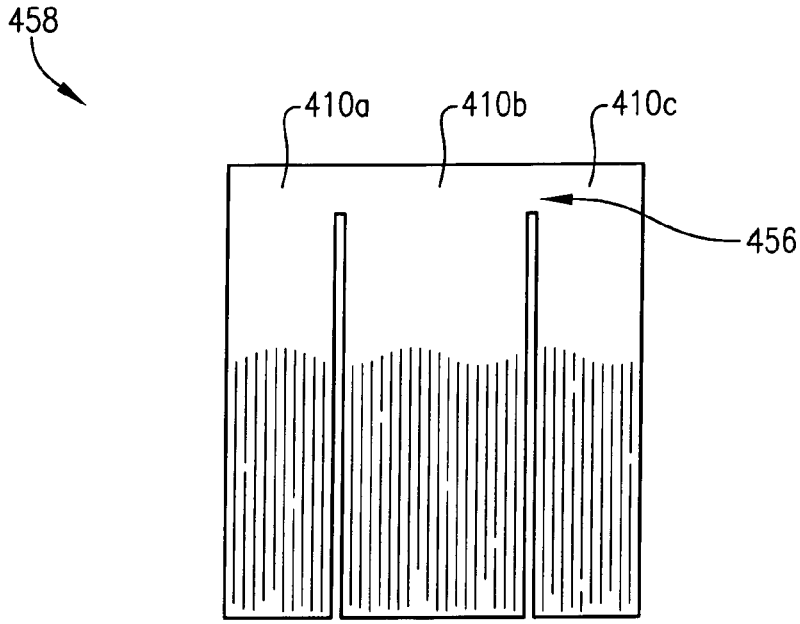
FIG. 6 is a plan view of three of the artificial shingles manufactured so as to be joined as a unit.

Referring particularly to FIG. 6, three of the artificial shingles 410*a*,410*b*,410*c* are manufactured so as to be joined by a connector 456 to form a unit 458. Preferably, the three artificial shingles are of different widths so as to further resemble shingles constructed of natural material. Joining the three shingles 410*a*,410*b*,410*c* as a unit 458 advantageously speeds mounting the shingles 410*a*,410*b*,410*c* to the roof structure. As needed, the connector 456 can be cut to result in a unit of two shingles or a single shingle.

Figure 7:
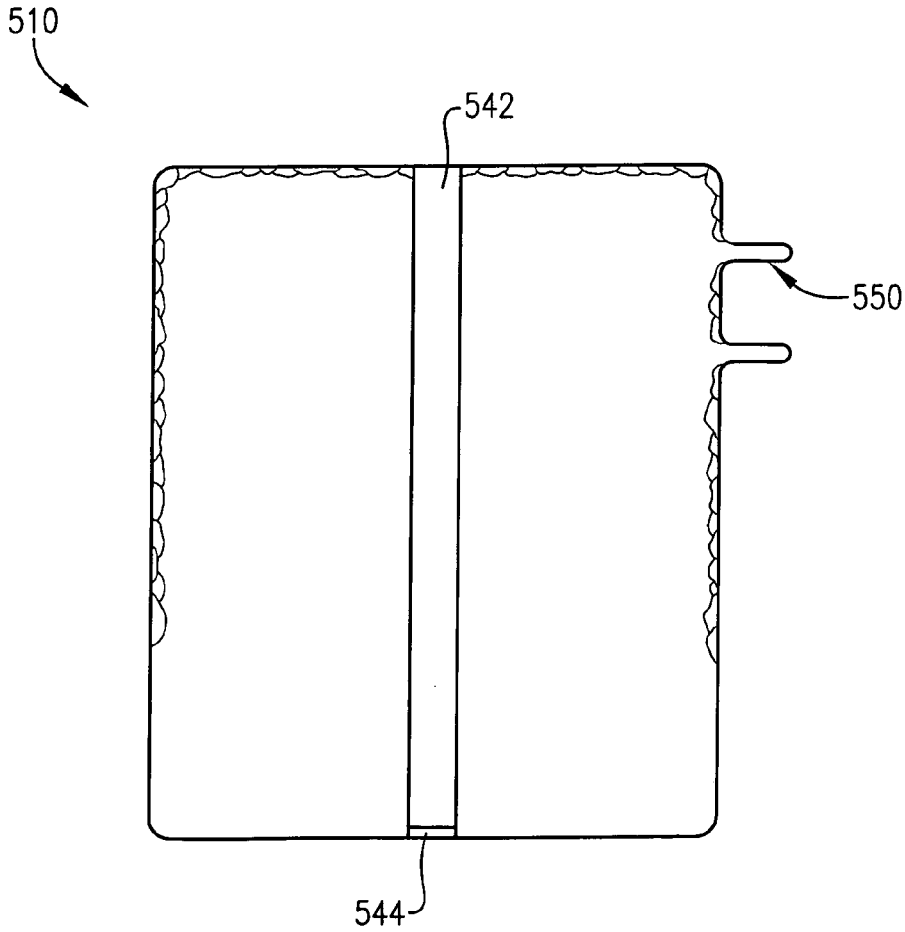
FIG. 7 is a plan view of a bottom surface of a preferred embodiment of an artificial slate shingle of the present invention, wherein spacers are shown for facilitating proper spacing of the shingle during installation.

Referring particularly to FIG. 7, an alternative slate version of the artificial shingle 510 is shown, wherein the artificial slate shingle 510 includes the midline groove 542; cuttable end tab 544; and one or more spacer projections 550. The spacer projection 550 extends perpendicularly or sidewardly from one or both sides of the elongated body 512 to such a distance and in such a manner as to facilitate properly spacing and otherwise aligning adjacent instances of the artificial slate shingle 550.

It is to be understood that the features described and shown herein in association with a particular version of the shingle, whether cedar or slate, may be incorporated into a shingle of the other or any other version, as desired.

In use and exemplary operation, the artificial shingle of the present invention functions as follows. In this example, the artificial shingle has been provided with a relief pattern that resembles natural slate, and the roof structure is of spaced slat-type construction. Courses of the artificial shingle are laid in a substantially conventional manner, with the spacer projections ensuring proper spacing and alignment between adjacent instances of the artificial shingle. The lower bottom overlap portions of subsequent or higher courses of the artificial shingle overlap the upper top overlap portions of preceding or lower courses of the artificial shingle. Where hips and valleys are encountered, the midline groove allows for easily and conveniently bending the artificial shingle to accommodate these non-planar surfaces. When finished, the lower top exposure portions are visible from outside or above the roof structure, and the upper bottom exposure portions are visible between the spaced slats from inside or below the roof structure. Thus, the appearance of natural material is achieved from both vantage points.

From the preceding description, it will be appreciated that the artificial shingle of the present invention provides a number of substantial advantages over the prior art, including, for example, providing the upper bottom exposure portion of the bottom surface with the relief or three-dimensional pattern, thereby advantageously allowing for a wider choice of roof structure design, including, for example, use of the spaced slat-type construction. Furthermore, the midline groove extending the length of the bottom surface of the elongated body advantageously facilitates bending the artificial shingle to accommodate non-planar areas of the roof structure. Additionally, the cuttable end tab can be cut as needed to facilitate folding the artificial shingle, but otherwise advantageously conceals the presence of the midline groove when the artificial shingle is mounted. Additionally, the portion of reduced thickness advantageously reduces cooling and set-up times during manufacture, and reduces the overall weight and material cost of the shingle. Additionally, the corrugations introduced into the portion of reduced thickness act to increase stiffness and strength and prevent sag which might otherwise arise due to the reduced thickness.

Although the invention has been described with reference to the preferred embodiments illustrated in the attached drawings, it is noted that equivalents may be employed and substitutions made herein without departing from the scope of the invention as recited in the claims. Furthermore, applications and uses are contemplated for the artificial shingle herein described that require only minor modifications to the device as disclosed. Thus, for example, though described herein as mimicking the appearance of natural cedar or slate, the artificial shingle is not limited thereto and may, instead, be provided a relief pattern to mimic substantially any natural material. It should also be noted that any or all of the various advantageous features described herein may be incorporated into a single shingle design, as desired, and are not exclusive of one another. Thus, for example, the features of the midline groove and the portion of reduced thickness may be incorporated into a single shingle design.

Having thus described the preferred embodiment of the invention, what is claimed as new and desired to be protected by Letters Patent includes the following:

1. An artificial shingle for mounting on a roof, the artificial shingle comprising:

an elongated body constructed from an artificial material, the elongated body including— a top surface having an upper top overlap portion and a lower top exposure portion, and a bottom surface having an upper bottom exposure portion and a lower bottom overlap portion, wherein the lower top exposure portion and the upper bottom exposure portion each present a relief pattern substantially resembling a natural material, the bottom surface including— a midline groove of reduced thickness extending the length of the elongated body to facilitate bending the artificial shingle.

2. The artificial shingle as set forth in claim 1, wherein the elongated body is approximately between 12 inches and 24 inches in length, and approximately between 4 inches and 18 inches in width.

3. The artificial shingle as set forth in claim 1, wherein the lower top exposure portion extends over approximately between 50% and 75% of the top surface, and the upper bottom exposure portion extends over approximately between 50% and 75% of the bottom surface.

4. The artificial shingle as set forth in claim 1, wherein the elongated body further includes an upper end and a lower end, and the lower end is thicker than the upper end.

5. The artificial shingle as set forth in claim 4, wherein the lower end is approximately between 0.25 inches and 0.75 inches in thickness.

6. The artificial shingle as set forth in claim 1, wherein the elongated body further includes a side and at least one spacer projection extending sidewardly therefrom.

7. The artificial shingle as set forth in claim 1, further including a portion of reduced thickness located at the lower portion of the bottom surface.

8. The artificial shingle as set forth in claim 7, wherein the portion of reduced thickness is provided with corrugations to increase strength and stiffness.

9. Three instances of the artificial shingle of claim 1 joined to form a unit, wherein the three instances are joined by two cuttable connectors, and each of the three instances presents a different width.

10. An artificial shingle for mounting on a roof, the artificial shingle comprising:

an elongated body and constructed from an artificial material, the elongated body including— a top surface having an upper top overlap portion and a lower top exposure portion, wherein the lower top exposure portion extends over at least approximately 50% and 75% of the top surface, and a bottom surface having an upper bottom exposure portion and a lower bottom overlap portion, wherein the upper bottom exposure portion extends over at-least approximately between 50% and 75% of the bottom surface, and wherein the lower top exposure portion and the upper bottom exposure portion each present a relief pattern substantially resembling a natural material, the bottom surface including— a midline groove of reduced thickness extending the length of the elongated body to facilitate bending the artificial shingle, and a cuttable end tab located at a bottom end of the midline groove, wherein the cuttable end tab can be cut as needed to facilitate folding the artificial shingle but otherwise conceals the presence of the midline groove when the artificial shingle is mounted to the roof.

11. An artificial shingle for mounting on a roof, the artificial shingle comprising:

an elongated body and constructed from an artificial material, the elongated body including— a top surface having an upper top overlap portion and a lower top exposure portion, and a bottom surface having an upper bottom exposure portion and a lower bottom overlap portion, and wherein the lower top exposure portion and the upper bottom exposure portion each present a relief pattern substantially resembling a natural material, the bottom surface including— a portion of reduced thickness located at the lower bottom overlap portion, and a plurality of corrugations within the portion of reduced thickness to increase stiffness and strength.

* * * * *